US009636536B2

(12) United States Patent
Gvoich

(10) Patent No.: US 9,636,536 B2
(45) Date of Patent: May 2, 2017

(54) RESISTANCE TRAINING APPARATUS

(71) Applicant: GVOICH FITNESS SYSTEMS, Baton Rouge, LA (US)

(72) Inventor: William Gvoich, Baton Rouge, LA (US)

( * ) Notice: Subject to any disclaimer, the term of this patent is extended or adjusted under 35 U.S.C. 154(b) by 0 days.

(21) Appl. No.: 14/517,517

(22) Filed: Oct. 17, 2014

(65) Prior Publication Data

US 2015/0141216 A1 May 21, 2015

Related U.S. Application Data

(60) Provisional application No. 61/892,758, filed on Oct. 18, 2013.

(51) Int. Cl.

| | |
|---|---|
| ***A63B 21/00*** | (2006.01) |
| ***A63B 21/055*** | (2006.01) |
| ***A63B 23/12*** | (2006.01) |

(52) U.S. Cl.

CPC .... *A63B 21/0555* (2013.01); *A63B 21/00043* (2013.01); *A63B 21/00185* (2013.01); *A63B 21/4035* (2015.10); *A63B 23/12* (2013.01)

(58) Field of Classification Search

USPC ..... 482/1–148; 267/69, 73, 74, 153

See application file for complete search history.

(56) References Cited

U.S. PATENT DOCUMENTS

| | | | | |
|---|---|---|---|---|
| 3,471,145 | A * | 10/1969 | Berger | A63B 21/00072 482/112 |
| 4,576,377 | A * | 3/1986 | Wolff | A63B 23/0355 482/113 |
| 5,000,475 | A * | 3/1991 | Gagneux | A63C 5/075 280/601 |
| 5,002,301 | A * | 3/1991 | Cagneux | A63C 5/075 280/601 |
| 5,042,798 | A * | 8/1991 | Sawicky | A63B 21/154 482/111 |
| 7,381,161 | B2 * | 6/2008 | Ellis | A63B 21/154 482/51 |
| 7,998,041 | B1 * | 8/2011 | Johnson | A63B 21/0552 482/124 |
| 8,079,942 | B2 * | 12/2011 | Anderson | A63B 21/0004 482/121 |
| 8,961,378 | B2 * | 2/2015 | Holland | A63B 21/4023 482/121 |
| 2005/0170937 | A1 * | 8/2005 | van Straaten | A63B 21/0552 482/124 |
| 2006/0217247 | A1 * | 9/2006 | Potak | A63B 21/0004 482/121 |
| 2007/0191129 | A1 * | 8/2007 | Kearns | A63B 69/3608 473/212 |
| 2011/0028287 | A1 * | 2/2011 | Kassel | A63B 21/0552 482/121 |
| 2012/0083395 | A1 * | 4/2012 | Carson | A63B 21/00061 482/129 |

(Continued)

*Primary Examiner* — Stephen Crow

(74) *Attorney, Agent, or Firm* — Ted M. Anthony

(57) ABSTRACT

A resistance training apparatus provides an elastic member for use in exercise strength training and fitness conditioning. The resistance training apparatus beneficially provides a user with a more consistent and even resistance tension throughout an exercise movement. The resistance training apparatus also provides for a greater training effect on an engaged muscle or muscle group.

6 Claims, 4 Drawing Sheets

(56) References Cited

U.S. PATENT DOCUMENTS

| | | | | |
|---|---|---|---|---|
| 2013/0190148 | A1* | 7/2013 | Allison | A63B 21/0442 482/129 |
| 2015/0126344 | A1* | 5/2015 | Wehrell | A63B 21/0442 482/128 |
| 2015/0182775 | A1* | 7/2015 | Toback | A63B 5/16 482/130 |
| 2015/0238799 | A1* | 8/2015 | Arline | A63B 21/0442 482/129 |
| 2015/0251038 | A1* | 9/2015 | Bybee | A63B 21/0442 482/124 |

* cited by examiner

RESISTANCE TRAINING APPARATUS

CROSS REFERENCES TO RELATED APPLICATION

Priority of U.S. Provisional Patent Application Ser. No. 61/892,758, filed Oct. 18, 2013, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to an exercise device for use in strength and fitness conditioning. More particularly, the present invention pertains to a resistance training apparatus that provides for substantially constant resistance throughout the entire duration of an exercise movement.

2. Brief Description of the Prior Art

Strength is an essential fitness component for people of all ages, and strength also plays an important role in maintaining muscle mass and a person's ability to participate in daily activities. Muscle not only gives a body its shape, but muscle also affects a person's resting metabolic rate (number of calories burned while at rest). Generally, people tend to lose strength and muscle mass due to inactivity and/or the aging process.

For older adults, in particular, strength plays an important role in several key functions, such as, for example, maintaining balance, preventing falls, and retaining bone density. Muscle loss, or sarcopenia, is a condition that affects many older people, and has a major impact on an older adult's functional ability and quality of life.

Resistance training is a preferred method for increasing muscle mass, and thus, getting stronger. As a result, there are several conventional resistance training tools that are commonly used to maintain and/or increase strength and muscle mass. A main criterion for strength improvement is to gradually increase the resistance that is placed on a muscle or muscle group, as said muscle becomes stronger; this strength improvement process is known as progressive resistance.

Strength can be increased by use of a variety of different methods, including, but not limited to, exercise machines, free weights, body weight exercises, and exercise (resistance) tubing or bands. However, while these methods can help increase strength, they also have certain shortcomings.

Exercise machines can be expensive and, generally, are only found in health clubs. Many people are intimidated by a health club atmosphere and also have a lack of knowledge regarding how to use said machines properly, without causing injury to themselves or others. Moreover, most of said exercise machines do not duplicate the physical movements that a person uses in his or her daily life. As a result, any benefit that may be gained by use of an exercise machine generally does not transfer into a person's real-world activity requirements.

Free weights are a preferred method for strength training by athletes and strength enthusiasts. Free weights are versatile, and can duplicate a variety of different movement patterns as used in everyday activities. Unlike exercise machines, free weights require use of additional muscle groups (stabilizers) and use of core strength in order to maintain balance during free weight exercises. In addition, said free weights provide instant feedback on how much weight a person is lifting, and thus, how much strength a person is gaining. However, many people do not use free weights properly or effectively as part of their strength training regimen, and many people can be especially intimidated by use of free weights.

Body weight exercises can also increase muscle strength and muscle mass when used in a progressive manner. However, many people do not have sufficient initial strength to be able to effectively use their own body weight as a means of strength training.

Exercise tubing has several key advantages over the use of exercise machines, free weights, and/or body weight exercises. Exercise tubing is typically not intimidating, is versatile, lightweight, and is capable of being used in almost any setting. Exercise tubing is frequently recommended as a form of resistance training for women, fitness enthusiasts and the elderly; however, it can also be used in physical therapy clinics for patients recovering from injuries or patients with low functional strength, and for sports/athletic conditioning.

Nonetheless, a common disadvantage of conventional exercise tubing is uneven tension during an exercise movement, from start to finish. Unlike free weights, exercise tubing does not indicate how much force is being applied, and ultimately, does not feel similar to lifting a free weight. For example, when using free weights, if a person lifts ten (10) pounds of weight, the weight is a constant ten (10) pounds throughout a duration of that entire exercise. Conversely, when using exercise tubing, the tension is relatively light at the beginning of an exercise, but then said tension increases dramatically near the completion of the movement of said exercise as the band is stretched. Thus, the tension forces generated by the band—the resistance perceived by the user—does not remain constant throughout the use of exercise tubing. Unlike free weights, a user of exercise tubing feels a majority of the resistance near the completion of a movement, thereby generally forcing said user to accelerate the speed of movement, thereby giving rise to improper or faulty exercise technique.

Additionally, a lower tension force that is placed on a muscle or muscle group at the beginning of an exercise movement with exercise tubing does not provide the necessary stimulation required for increasing strength, particularly as compared to free weights or exercise machines. Thus, said low initial tension force reduces potential muscle stimulation and minimizes training results, thereby giving rise to faulty exercise technique.

The tension properties of an elastic (typically, but not exclusively rubber) tubing that can be used for exercise resistance training have the same or similar tension curve profiles (tension curve): low tension at the start of an exercise and a very rapid increase in tension during the last portion of a movement of said exercise. As a result of such a shortcoming, conventional exercise tubing is not considered to be as effective as free weights or any other strength training methods.

As a result, there is a need for an exercise tubing, band or other elastic member for use in resistance training that can: (1) provide increased resistance at an earlier point in time during an exercise movement spectrum; and (2) maintain substantially constant tension forces throughout an entire exercise motion.

SUMMARY OF THE INVENTION

The present invention comprises a resistance training apparatus that can provide a user with greater resistance earlier in an exercise movement compared to conventional stretchable exercise devices. The apparatus of the present invention can also be used to provide a user with a substantially constant and consistent resistance throughout an entire exercise movement. In addition, the resistance training apparatus of the present invention overcomes a drawback of a steep tension curve common with traditional exercise bands or tubing by adjusting the mass (typically via a thickness, diameter, and/or width of a tubing or a band) along a length of said tubing or band.

In a preferred embodiment, the resistance training apparatus of the present invention exhibits several key advantages and addresses a number of negative characteristics of existing, conventional exercise tubing or bands in which resistance increases dramatically with stretching. An additional advantage and benefit of the resistance training apparatus of the present invention is its superior training effect on a muscle or muscle group that is being engaged and worked by use of said apparatus. As a result, a user is able to perform an entire exercise movement with a substantially consistent resistance level, and thus, is not required to accelerate the speed of movement in order to finish an exercise movement.

Additionally, in a preferred embodiment, the resistance training apparatus of the present invention allows resistance (tension force) to be substantially constant over a greater distance during an exercise movement. As a result, a work output of the present invention is greater than a work output of conventional exercise tubing, thereby increasing muscle stimulation and training results.

A change in thickness and/or diameter of a resistance tubing or band along its length modifies the tension curve that is found in an existing, conventional exercise tubing device. Moreover, a change in thickness and/or diameter along the length of a tubing or surface area along the length of a band, provide a more constant resistance during an exercise motion.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
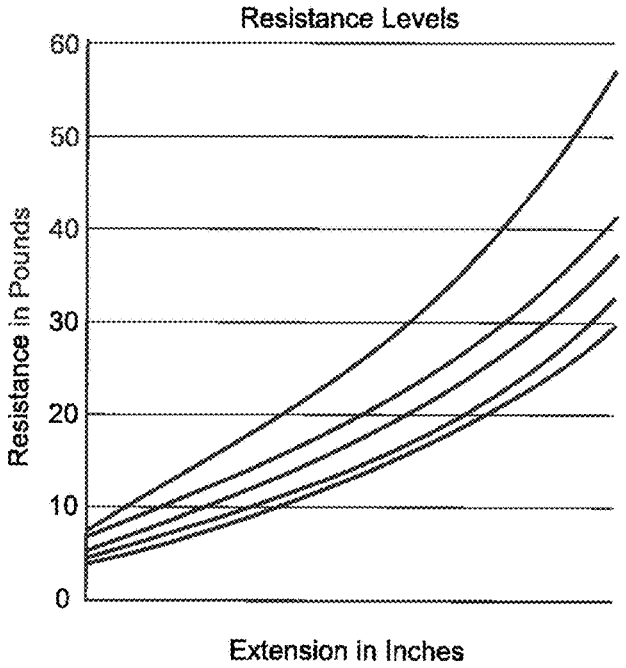
FIG. 1 depicts a graphic illustration of steep tension curve profiles of existing conventional exercise tubing or bands.

Referring to the drawings, FIG. 1 depicts a graph illustrating a tension curve profile for a conventional elastic exercise member such as, for example, a tubing or band. The x-axis of FIG. 1 represents a length of extension of said conventional exercise member, while the y-axis represents the amount of tension force, or resistance to stretching, exhibited by said conventional exercise member when stretched or extended. Thus, FIG. 1 illustrates representative resistance levels of conventional elastic exercise members during the course of an exercise movement as said members are stretched or extended.

As illustrated in FIG. 1, where the axial extension of an conventional elastic member is very low at the beginning of an exercise, the resistance to stretching (tension) exhibited by said conventional exercise band is also low. Conversely, there is a sharp increase in tension forces near the completion of said exercise, which illustrates that when a conventional exercise member is extended in a longer length, the tension forces of the conventional exercise member increase rapidly. Even within a substantial mid-range of said exercise movement using a conventional elastic exercise member, the tension forces remain low.

Figure 2:
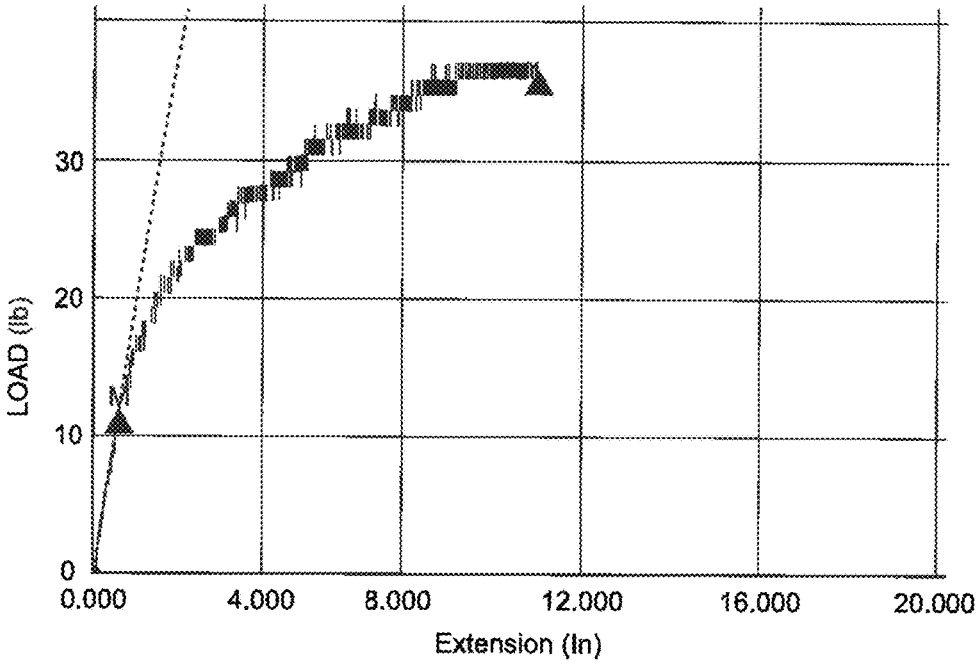
FIG. 2 depicts a graphic illustration of a tension curve profile of a resistance training apparatus of the present invention.

FIG. 2 depicts a graph illustrating a tension curve profile for an elastic resistance training apparatus of the present invention. The x-axis of FIG. 2 represents the length of extension of said resistance training apparatus, while the y-axis represents the amount of tension force, or resistance to stretching or elongation, of said resistance training apparatus of the present invention as it is stretched or extended. Thus, FIG. 2 depicts resistance levels of the elastic resistance training apparatus of the present invention during the course of an exercise movement.

As illustrated in FIG. 2, the elastic resistance training apparatus of the present invention has a more constant and even resistance throughout an entire range of motion of an exercise movement than conventional elastic training members (such as, for example, tubing or bands), thereby producing more consistent and beneficial work for a user during a normal exercise repetition. Additionally, the resistance training apparatus of the present invention has a relatively higher resistance level throughout a mid-range, or critical stage, of an exercise movement than convention exercise devices. Therefore, said elastic resistance training apparatus of the present invention has a substantially flatter tension curve profile, which represents a substantially constant or consistent resistance level throughout extension and contraction of said resistance training apparatus.

Figure 3:
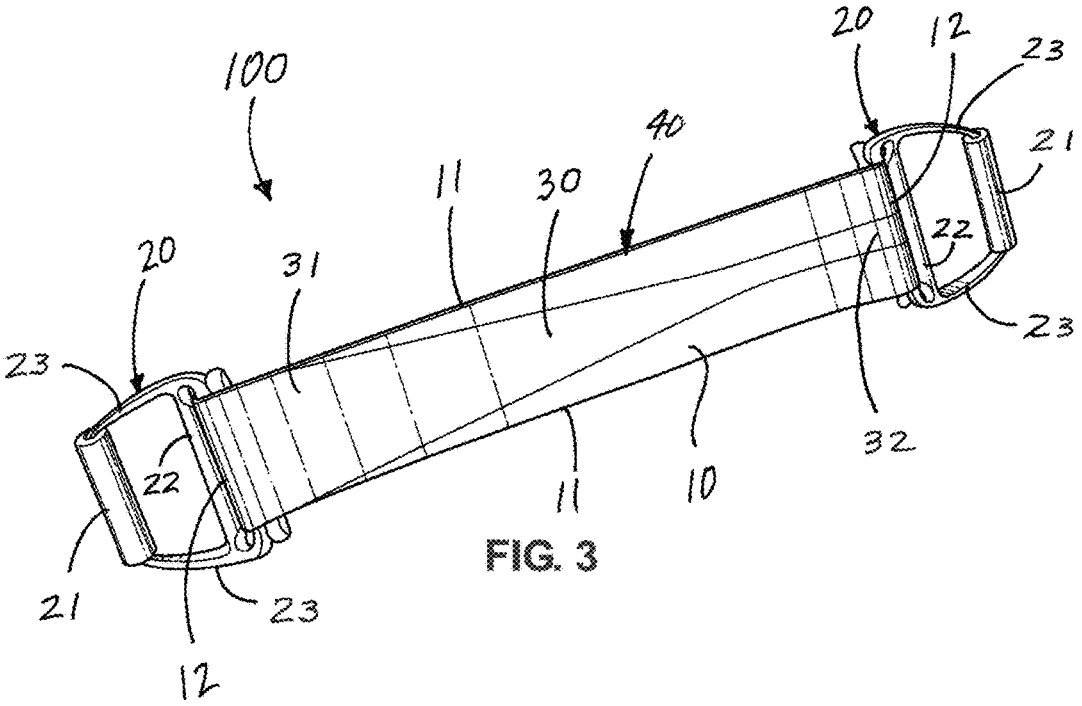
FIG. 3 depicts a side perspective view of a preferred embodiment of a resistance training apparatus of the present invention.

FIG. 3 depicts a perspective view of a preferred embodiment of an elastic resistance training apparatus 100 of the present invention generally comprising elastic band member 40 and handle members 20. Elastic band member 40 generally comprises a first layer 10 having longer sides 11 and relatively shorter sides 12, thereby forming a substantially rectangular shape. Said longer sides 11 are oriented substantially parallel to each other, while said shorter sides 12 are oriented substantially parallel to each other; said longer sides 11 and said shorter sides 12 cooperate to form first layer 10 of elastic band member 40. Further, said shorter sides 12 are each connected and attached to a handle member 20 of the present invention.

In a preferred embodiment, said handle members 20 each generally comprise a grip member 21, an attachment member 22 and a plurality of side members 23. Said grip member 21 and said attachment member 22 are oriented substantially parallel to each other, while said side members 23 are oriented substantially parallel to each other; said grip, attachment, and side members cooperate to form an inner space within said handle member 20. Said inner space provides a pathway for a user to comfortably and securely grasp said grip member 21 of said handle member 20. Said attachment member 22 generally defines an elongate opening or a slit that functions as a pathway or attachment point for a short side 12 of said band member 10, thereby allowing the ends (short sides 12) of said elastic band member 40 to connect to each handle member 20.

Still referring to FIG. 3, in the embodiment depicted in FIG. 3, elastic band member 20 generally comprises a plurality of resilient layers 10 and 30. As noted above, first resilient layer 10 comprises a substantially rectangular shaped configuration having a substantially consistent wall thickness and width. A second resilient layer 30 comprises a tapered or substantially "V" shaped configuration that has a substantially greater width at end 31 and beneficially tapers in width toward opposing end 32.

In a preferred embodiment, when said layers 10 and 30 are engaged and stretched by being pulled and axially extended, a tensile force acts upon said resilient layers. Axial stretching by a user causes a tensile force that remains substantially constant throughout an entire exercise movement.

By way of illustration, but not limitation, said elastic band member layers 10 and 30 can be manufactured from a latex material, or any other suitable material having similar desired elastic characteristics. Alternatively, it is to be observed that aesthetic modifications may also be made to make said resistance training apparatus more visually appealing, such as, for example, encapsulating the elastic band member with a coating or stretchable casing to make it appear more solidified and uniform.

Figure 4:
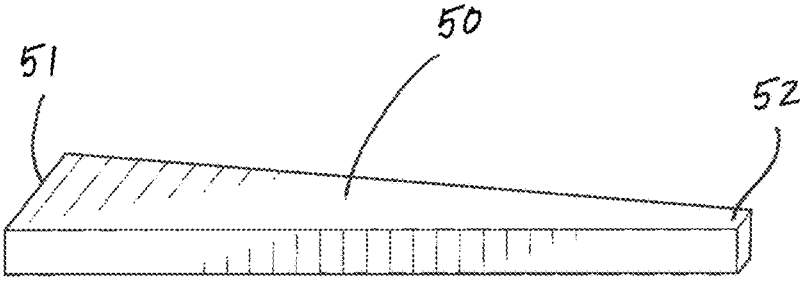
FIG. 4 depicts a side perspective view of an alternative embodiment of a resistance training band of the present invention having a tapered width.

FIG. 4 depicts a perspective view of an alternative embodiment elastic band member 50 of a resistance training apparatus of the present invention. A first end 51 of elastic band member has a greater mass and comprises a substantially wider segment of band member 50 than substantially narrower second end 52 of said elastic band member 50. By way of illustration, but not limitation, said elastic band member 50 can be stretched and axially extended. The change in mass along the length of said elastic band member 50 causes tension forces to remain substantially constant when said band 50 is axially extended and contracted.

Figure 5:
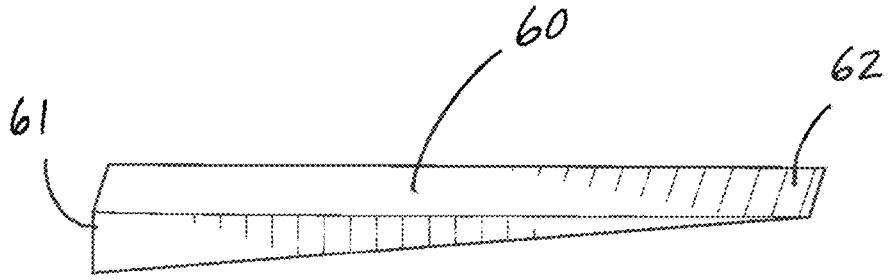
FIG. 5 depicts a side perspective view of an alternative embodiment of a resistance training band of the present invention having a tapered thickness.

FIG. 5 depicts a perspective view of a another alternative embodiment elastic band member 60 of resistance training apparatus of the present invention. A first end 61 of elastic band member 60 comprises a substantially thicker section having more mass than relatively thinner second end 62 of said elastic band member 60. Similarly, the change in mass along the length of said elastic band member 60 causes tension forces to remain substantially constant when said band 60 is axially extended and contracted.

Figure 6:
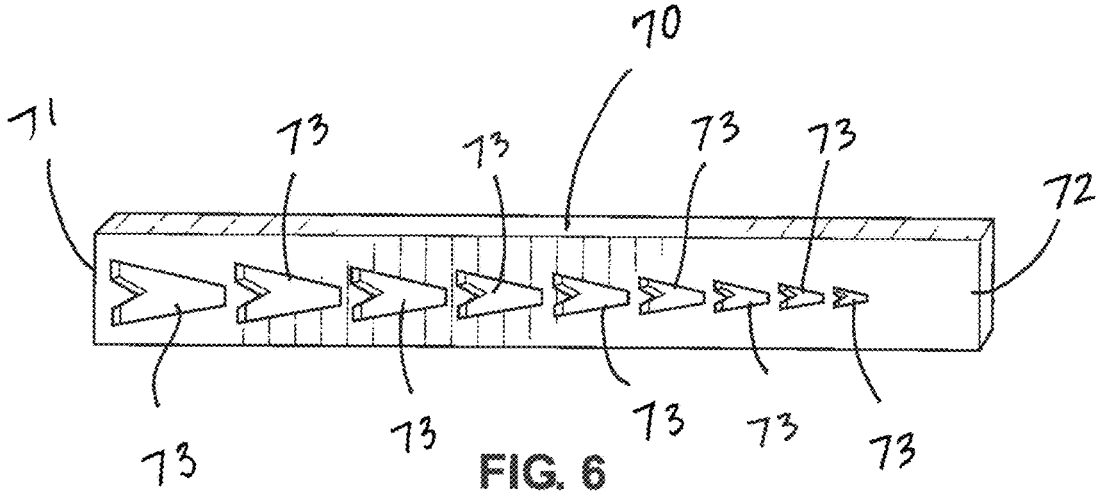
FIG. 6 depicts a side perspective view of an alternate embodiment of a resistance training band of the present invention having a plurality of ribs disposed along its length.

FIG. 6 depicts a perspective view of another alternate embodiment elastic band member 70 of resistance training apparatus of the present invention comprising a plurality of ribs 73 within said elastic band member 70. In a preferred embodiment, said plurality of ribs 73 can be equidistantly spaced along a longitudinal axis of said elastic band member 70 between ends 71 and 72. In a preferred embodiment, said ribs 73 generally have a substantially thicker and larger size at a first end 71 of said band member 70, gradually decreasing in size towards second end 72 of said band member 70. The decreasing size of said ribs 73 creates a change in mass axially along band 70, thereby beneficially allowing said band member 70 to maintain a substantially constant resistance level throughout axial extension and contraction of said resistance training apparatus 70. It is to be observed that said ribs 73 can be configured in a variety of different shapes or designs, depending on a desired appearance of said resistance training apparatus.

Figure 7:
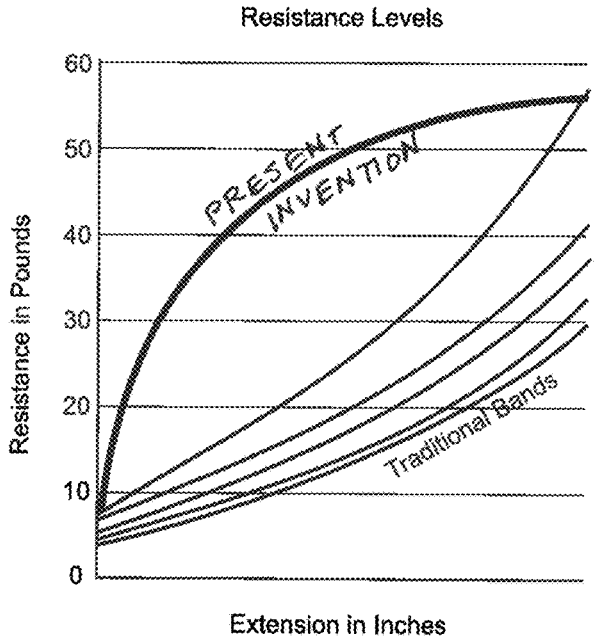
FIG. 7 depicts a graphic illustration comparing resistance of a preferred embodiment of a resistance training apparatus of the present invention versus conventional elastic resistance training tubing or bands.

FIG. 7 depicts a graph illustrating a tension curve profile for the resistance training apparatus of the present invention as compared to a tension curve profile for a conventional elastic exercise member. On FIG. 7, the x-axis represents a length of extension of an elastic resistance training apparatus, while the y-axis represents tension force or resistance of each resistance training apparatus upon axial extension. Thus, FIG. 7 represents a comparison of resistance levels for said resistance training apparatus of the present invention as compared to conventional elastic exercise members.

As depicted in FIG. 7, a conventional exercise tubing or band has a substantially steeper tension curve profile, whereas said resistance training apparatus of the present invention has a much different tension curve profile; the resistance training apparatus of the present invention exhibits a substantially constant or consistent resistance level throughout extension and contraction of said resistance training apparatus.

Figure 8:
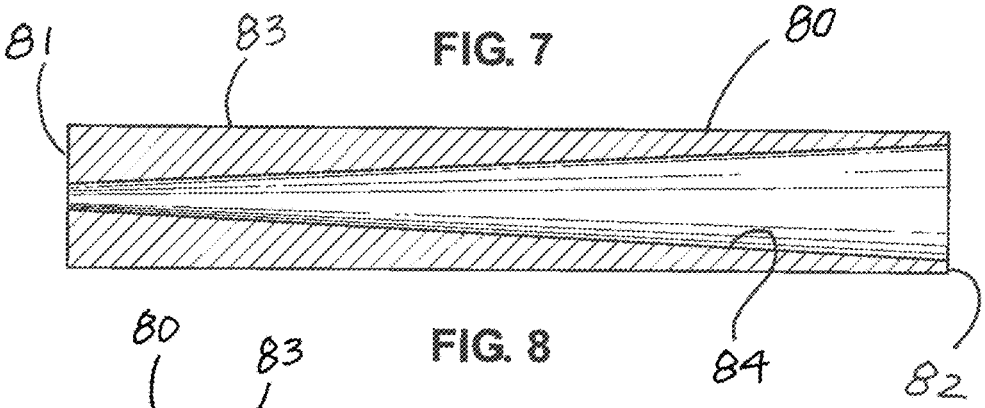
FIG. 8 depicts a side sectional view of an alternate embodiment of a tubular resistance training apparatus of the present invention.

FIG. 8 depicts a side sectional view of an alternate embodiment of an elastic resistance training apparatus 80 comprising an elastic tube member. Elastic tube member 80 has a substantially cylindrical shape having a first end 81, a second end 82, and a central bore extending axially therethrough from said end to said second end. Said tube 80 has an outer diameter defined by outer surface 83, and an inner diameter defined by inner (bore) surface 84. In a preferred embodiment, said outer surface 83 has uniform outer diameter dimension along the length of said tube 80, while the wall thickness of tube 80 gradually decreases from end 81 to opposing end 82. This decrease in wall thickness or tapering of said inner diameter increases mass of said elastic tube member from a first end 81 to a second end 82, allowing tube 80 to maintain a substantially constant resistance throughout axial extension and contraction of said elastic tube member 80.

Figure 9:
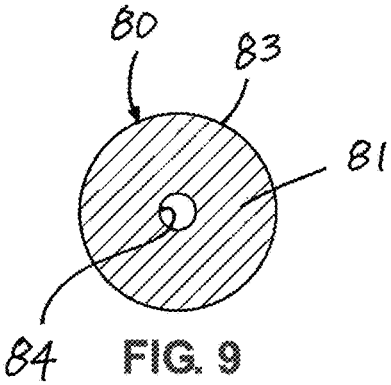
FIG. 9 depicts a first end view of an alternate embodiment of a tubular resistance training apparatus of the present invention depicted in FIG. 8.

FIG. 9 depicts an end view of first end 81 of an alternate embodiment of elastic tube member 80. As depicted in FIG. 9, first end 81 generally comprises the thickest wall section of said tube 80, thereby also comprising a relatively smaller inner diameter (and greater mass) than at opposing second end 82 of elastic tube member.

Figure 10:
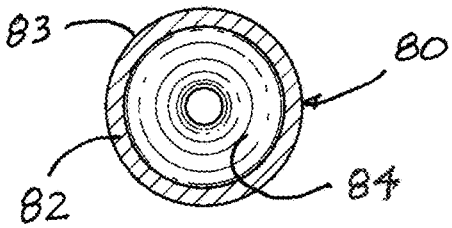
FIG. 10 depicts a second end view of an alternate embodiment of a tubular resistance training apparatus of the present invention depicted in FIG. 8.

FIG. 10 depicts an end view of a second end 82 of alternate embodiment elastic tube member 80. As depicted in FIG. 10, said second end 82 generally comprises a substantially thinner wall of said tube 80, thereby also comprising a relatively larger inner diameter (and less mass) than at first end 81 of elastic tube member 80.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A resistance training apparatus comprising an elongate elastic tube having a first end, a second end and a central bore extending from said first end to said second end, wherein the mass of said tube at said first end is greater than the mass of said tube at said second end, and wherein said elongate elastic tube generates a substantially constant tensional force in response to axial extension.

2. The resistance training apparatus of claim 1, wherein said central bore defines an inner diameter, and said inner diameter of said bore increases from said first end to said second end.

3. The resistance training apparatus of claim 1, wherein said tube defines a wall thickness, and said wall thickness decreases from said first end to said second end.

4. A method of resistance training comprising:

a) gripping at least one end of an elongate elastic tube having a first end, a second end and a central bore extending from said first end to said second end, wherein the mass of said tube at said first end is greater than the mass of said tube at said second end; and b) axially extending said elongate elastic member wherein said elongate elastic member generates a substantially constant tensional force in response to said extension.

5. The resistance training method of claim 4, wherein said central bore defines an inner diameter, and said inner diameter of said central bore increases from said first end to said second end.

6. The resistance training method of claim 4, wherein said tube defines a wall thickness, and said wall thickness decreases from said first end to said second end.

* * * * *